US005316117A

United States Patent [19]

Griner et al.

[11] Patent Number: 5,316,117

[45] Date of Patent: May 31, 1994

[54] BILL VALIDATOR WITH ANTI-STRINGING SHUT-DOWN FEATURE

[75] Inventors: Paul K. Griner, St. Louis; Paul T. Smith, Florissant, both of Mo.

[73] Assignee: Unidynamics Corporation, New York, N.Y.

[21] Appl. No.: 846,780

[22] Filed: Mar. 4, 1992

[51] Int. Cl.[5] ..... G07D 7/00

[52] U.S. Cl. ..... 194/203; 194/206

[58] Field of Search ..... 194/202, 203, 206, 207; 209/534

[56] References Cited

U.S. PATENT DOCUMENTS

| | | | |
|---|---|---|---|
| 3,190,426 | 6/1965 | Cahill et al. . | |
| 3,227,256 | 1/1966 | Schepflin | 194/203 |
| 4,348,656 | 9/1982 | Gorgone et al. | 340/146.3 |
| 4,437,558 | 3/1984 | Nicholson et al. . | |
| 4,503,963 | 3/1985 | Steiner . | |
| 4,513,439 | 4/1985 | Gorgone et al. | 382/7 |
| 4,587,434 | 5/1986 | Roes et al. | 250/556 |
| 4,834,230 | 5/1989 | Kondo et al. | 194/206 |

*Primary Examiner*—F. J. Bartuska

*Attorney, Agent, or Firm*—Senniger, Powers, Leavitt & Roedel

[57] ABSTRACT

A bill validator for evaluating paper articles includes a bill guide for receiving the paper articles. A bill protector validates the received articles corresponding to genuine currency and rejects all other articles. A sensor measures a portion of the article which passes a predetermined position of the bill guide during receiving by the bill guide and further measures the portion of the article and any other articles which pass the predetermined position during rejection. The bill validator is disabled for a predetermined period of time if the measurement of the portion of the article during receiving differs from the measurement taken during rejection. As a result, the bill validator is disabled in the event that a user attempts to remove an article with a rejected article causing the measurement of the received article to differ from the measurement taken during rejection.

35 Claims, 2 Drawing Sheets

BILL VALIDATOR WITH ANTI-STRINGING SHUT-DOWN FEATURE

BACKGROUND OF THE INVENTION

1. Field of the Invention

The invention relates to apparatus for controlling the operation of a currency changer and, in particular, to an apparatus for controlling the operation of a currency changer including a paper currency acceptor.

2. Description of the Prior Art

Devices that perform one or more tests on U.S. bills or other paper currency to determine their genuineness in order to dispense change are well known in the prior art. Typically, in such devices, the paper currency being validated is moved over a path along which various optical, magnetic or edge sensing tests are performed. On failing any of these tests, the bill is moved along the path in a reversed direction to be returned to the user and no credit is given. For example, a bill is moved along a path at a uniform rate of speed past a pair of photocells spaced farther apart than the length of the bill. If both photocells are covered simultaneously, the inserted object is rejected, since it cannot be a genuine bill.

Such prior art validators are subject to tampering and defrauding. For example, strings are sometimes attached to currency which is provided to a change machine. After change is given, an unacceptable article is fed to the change machine. As the unacceptable article is being rejected, the user pulls the stringed article out simultaneously therewith. There is a need in the prior art for bill validators which prevent repeated withdrawal of stringed bills thereby preventing a user which tampers or defrauds a change machine from emptying the bill change machine of its change.

SUMMARY OF THE INVENTION

It is an object of this invention to provide a bill validator which prevents repeated withdrawal of stringed bills.

It is a further object of this invention to provide a bill validator which discourages defrauding and tampering by shutting down for a pre-determined period of time when such defrauding or tampering is detected.

It is another object of this invention to provide a bill validator which is disabled for selected periods of time and responds to certain conditions suggesting tampering or defrauding.

Other objects and features will be in part apparent and in part pointed out hereinafter.

The bill validator according to the invention evaluates paper articles. A bill guide receives the paper articles. Means validates the received articles corresponding to genuine currency and rejects other articles. Means measures a portion of the article which passes a predetermined position of the bill guide during receiving by the bill guide and further measures the portion of the article and any other articles which pass the predetermined position during rejection. Means responsive the measure means disables the bill validator if the measurement of the portion of the article during receiving differs from the measurement during rejection. As a result, the bill validator is disabled in the event a user attempts to remove an article with a rejected article causing the measurement of the received article to differ from the measurement taken during rejection.

In another form, the bill validator includes means for validating the received article corresponding to genuine currency and for rejecting other articles Means detects tampering causing the rejection of coins or currency in excess of the validated amount of received currency Means responsive to the detecting means disables the bill validator if the rejected coins or currency exceed the validated amount of received currency. Thereby, the bill validator is disabled in the event that a user attempts to tamper with the bill validator by removing coin or currency in an unauthorized matter.

In another form, the invention comprises the method of securing the currency in a bill validator, including the following steps: receiving the paper articles; validating the received articles corresponding to genuine currency; rejecting articles not validated; detecting tampering causing the rejection of coins or currency in excess of the validated amount of received currency; and disabling the bill validator if the rejected coins or currency exceeds the validated amount of received currency.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
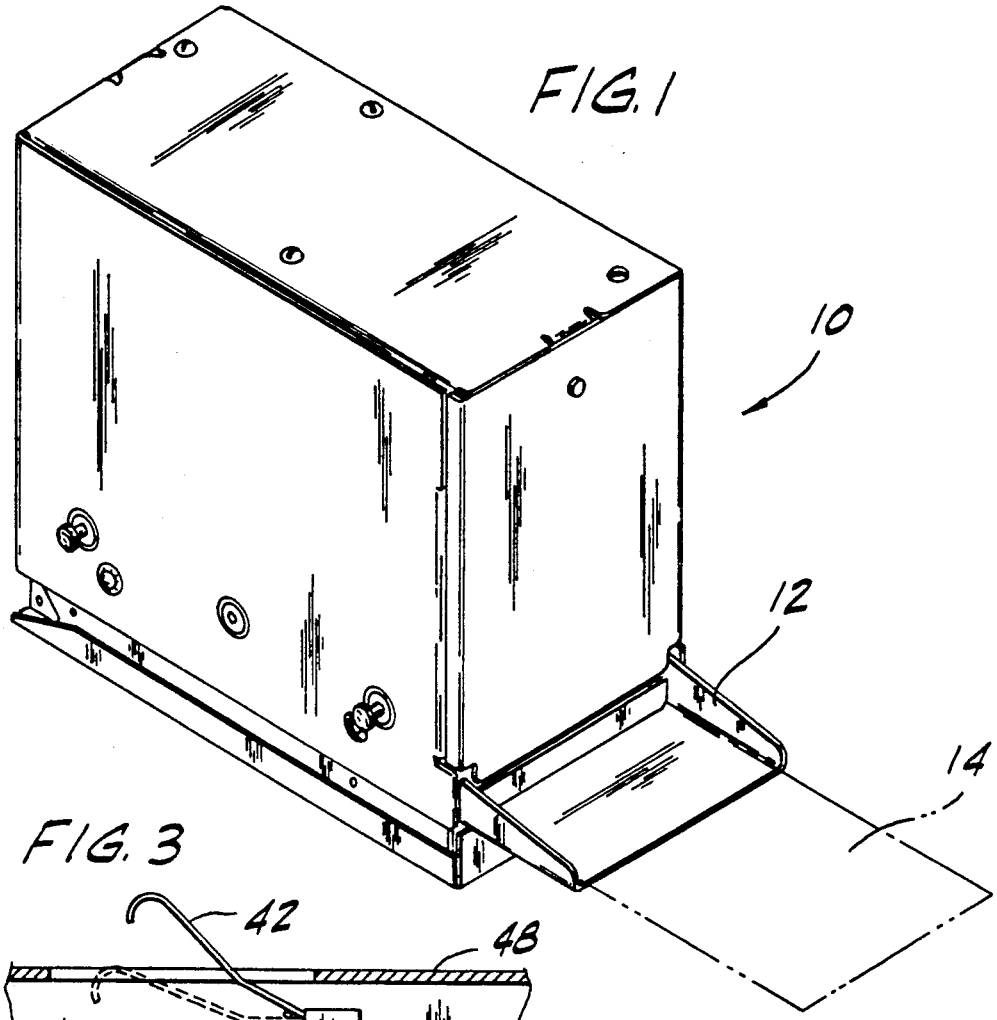
FIG. 1 is a perspective view of a bill validator of the inventor.

A bill validator of the present invention is generally indicated by reference character 10 in FIG. 1. Validator 10 has a bill guide 12 for receiving a paper article 14 (shown in phantom). Article 14 is intended to be genuine currency verified and to be credited by validator 10 at its face value. Article 14 may be any other paper product which a user may insert into bill guide 12 in an effort to defraud validator 10 in an attempt to generate an improper credit. Validator 10 is hinged in the back and may be opened to show the path along bill guide 12 which article 14 follows during receipt of article 14 by validator 10.

Figure 2:
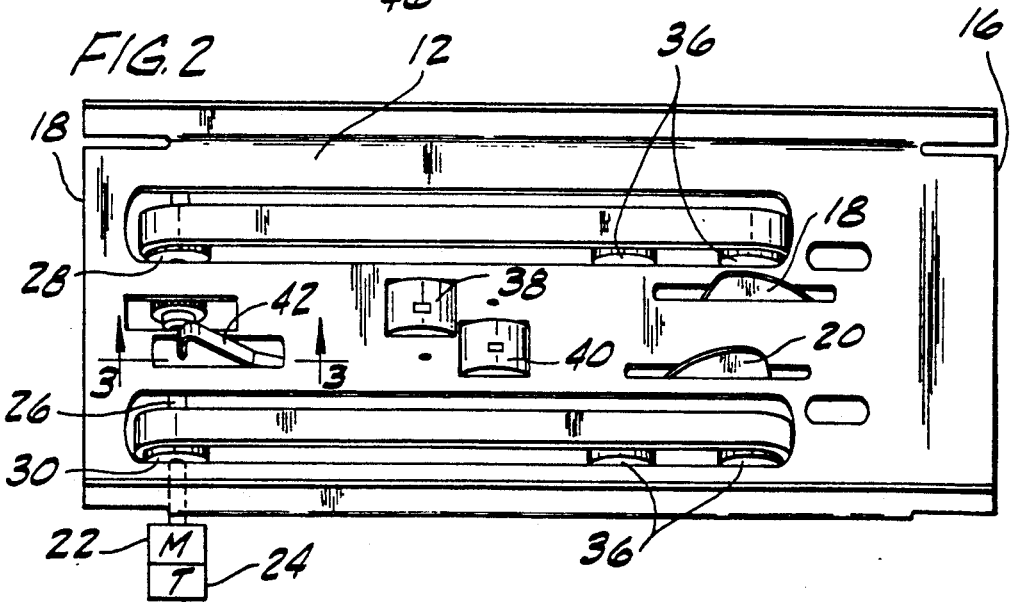
FIG. 2 is a plan view of the bill guide of FIG. 1.

FIG. 2 shows that path along bill guide 12 which article 14 follows. Bill guide 12 has a front 16 for receiving an article 14 (not shown in FIG. 2) and has a back section 18 over which article 14 passes after being validated. When a user inserts an article 14 into the front 16 of bill guide 12, the leading edge of the article engages a member 18 to close its associated switch 19 (see FIG. 4) and then engages member 20 to close its associated switch 21 (see FIG. 4). The closure of the switches 19 and 21 energizes motor 22 through the circuitry of FIG. 4 as more fully described below. Motor 22 includes a tachometer 24 which emits pulses to the circuitry of FIG. 4. Motor 22 is coupled to shaft 26 and pulleys 28 and 30. Energization of motor 22, therefore, rotates pulleys 28 and 30 causing transport bands 32 and 34 to pass over idler pulleys 36.

Transport bands 32 engage the inserted article 14 and transport article 14 from the front 16 of bill guide 12 to the back 18. As article 14 passes along bill guide 12, the Printing on article 14 is examined by electromagnetic pickup heads 38 and 40. Heads 38 and 40 are known in the art and positioned to detect identifying characteristics on the currency which is used in validator 10 to verify the authenticity of the currency.

Figure 4:
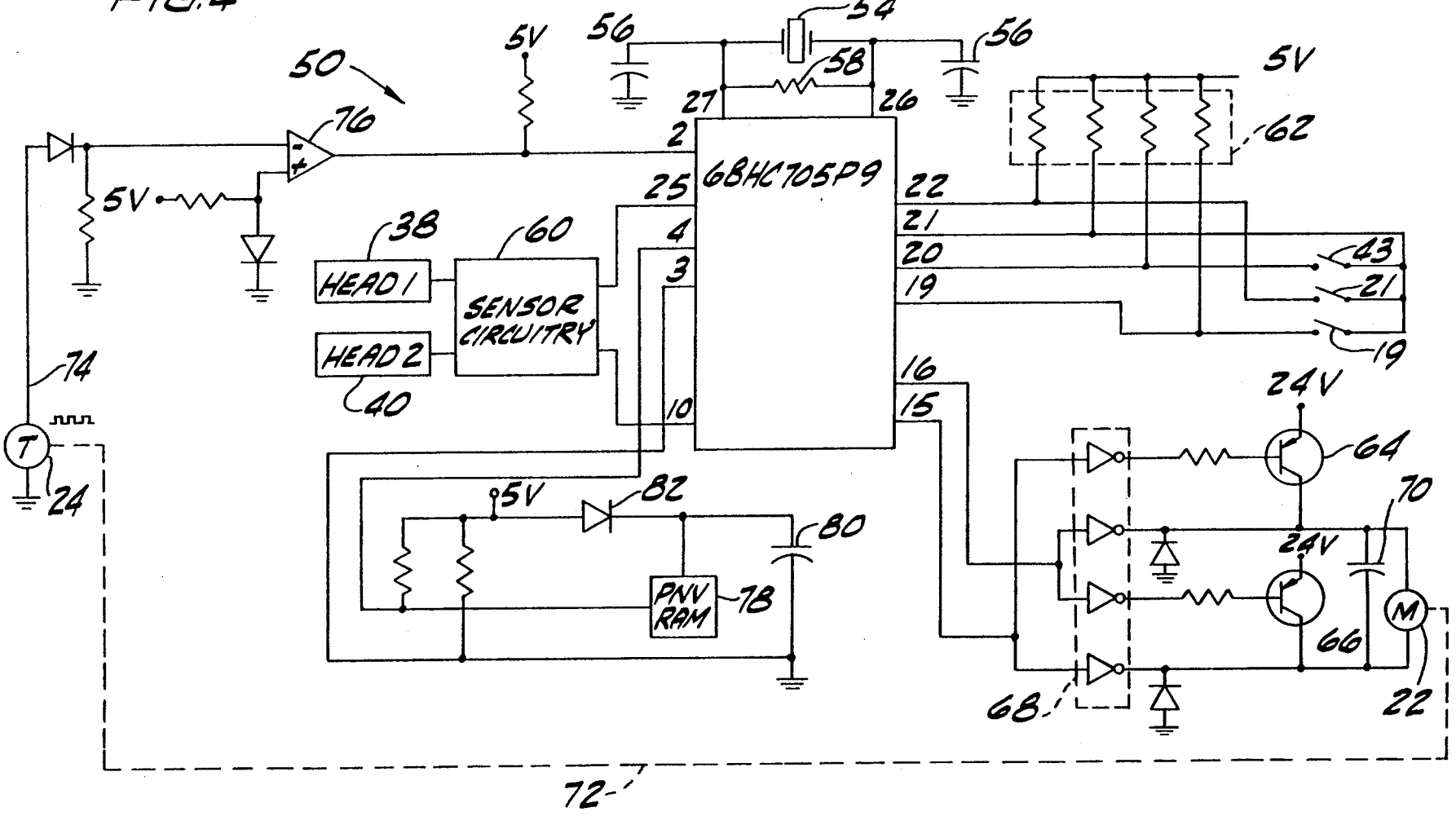
FIG. 4 is a schematic diagram of the circuit for controlling the bill validator of the invention.

Member 20 is positioned slightly rearward of member 18 to allow the circuitry of FIG. 4 to sense the direction in which article 14 is passing along bill guide 12.

As article 14 travels from front 16 to back 18 along the bill guide 17. The leading edge of article 14 next engages arm 42 to close its associated switch 43 (see FIG. 3). Closure of switch 43 resets the counter in the circuitry of FIG. 4 and initiates the anti-stringing security feature of the present invention.

In addition to its use to trip electrical switch 43, arm 42 also mechanically deters the removal of currency from validator 10. Movable arm 42 closes switch contacts (not shown) within housing 46. Once valid currency has passed switch 43, arm 42 returns to its rest position above the surface 48 of bill guide 12. If a user attempts to pull valid currency back through bill guide 12 across surface 48, arm 42 mechanically obstructs the path to prevent such removal.

FIG. 4 shows circuitry 50 which is used to control validator 10. Circuitry 50 includes a microprocessor 52. Microprocessor 52 is preferably integrated circuit number 68HC705P9 as manufactured and sold by Motorola. Circuitry 50 includes 4.0 MHZ crystal 54, capacitors 56 and resistor 58 for setting any operating frequency of microprocessor 52. Microprocessor 52 tests the genuineness of an inserted article 14 through operation of electromagnetic heads 38 and 40 and sensor circuitry 44 via connection to pins 10 and 25 of microprocessor 52. The operation and configuration of heads 38 and 40 and sensor circuitry 60 is well known in the art without further disclosure.

Circuitry 50 also includes switches 19, 21 and 43 which are connected to microprocessor 52 through pins 19, 20, 21, and 22, respectively. Pull up resistors 62 insure that appropriate logic levels are maintained by microprocessor 52. Microprocessor 52 uses switches 19, 21 and 43 to determine the position of article 14 along bill guide 12. Closures of one of the switches indicates to microprocessor 52 the presence of article 14 over the corresponding switch.

Microprocessor 52 controls the operation of motor 22 through pins 15 and 16, switching transistors 64 and 66, inverters 68 and the related circuitry. When microprocessor 52 applies a voltage to pin 15, motor 22 rotates in the forward direction to transport article 14 from the front 16 of bill guide 12 to the back 18. When microprocessor 52 applies the voltage to pin 16, motor 22 rotates in the reversed direction for discarding any articles 14 from bill guide 12. Capacitor 70 is connected across the terminals of motor 22 to reduce the power factor.

Motor 22 is coupled to tachometer 24 as illustrated by dashline 72. Tachometer 24 emits pulses on line 74 corresponding to the number of rotations of motor 22. Microprocessor 52 counts the number of pulses emitted on line 74 through operational amplifier 76, pin 2 and the related circuitry. By controlling the direction of rotation of motor 22 and by counting the number of pulses from tachometer 24, microprocessor 52 can calculate the distance article 14 is transported along bill guide 12.

In operation of this particular embodiment, microprocessor 52 begins counting the number of pulses on line 74 when the leading edge of article 14 first activates switch 43. Microprocessor 52 increments the count with the occurrence of each pulse until article 14 is either accepted as valid currency or rejected. If article 14 is accepted, the count is ignored and the counter is reset. If article 14 is rejected, then microprocessor 52 decrements the count for each pulse from tachometer 24 which occurs while motor 22 operates in the reversed direction to discard article 14. Microprocessor 52 continues to decrement the count until the leading edge of article 14 passes switch 42. If only one article 42 is involved with the particular rejection operation of validator 10, then the count should be decremented back down to approximately 0. This indicates that the length of the portion of article 14 which extended beyond switch 42 during the receiving cycle is approximately equal to the length of the portion of article 42 which passed back over switch 42 during the rejection cycle. If, however, the user is using a string to remove currency which was previously validated, then the measured length on rejection will be different from the measured length during the receiving cycle. If the stringed bill lags behind the rejected article 14, then the measured length during rejection will be too long and the count will be decremented below 0. If the user pulls the stringed bill out too quickly, the measured length may be too short and the count will not decrement all the way down to 0. Microprocessor 52 recognizes both conditions as an attempt to tamper with and defraud validator 10 with a string and responds by entering a disabled mode by disabling validator 10 for a predetermined period of time, typically 15 minutes. Accordingly, a user will be able to remove coinage corresponding to a single article of currency from validator 10. However, the user will not be able to loot the entire machine.

In order to prevent a user from unplugging validator 10 from a wall outlet which powers validator 10 through circuitry not shown, thereby resetting the disabled mode discussed above, circuitry 50 is provided with Programmable, non-volatile random access memory 78 for storing data representative of the disabled state for validator 10. In the event a user disconnects external power to validator 10 during a period when microprocessor 52 has disabled validator 10, validator 10 will remain disabled when external power is again connected. This occurs because microprocessor 52 initially checks memory 78 via pins 3 and 4 for data representative of a disabled state. If memory 78 indicates such a disabled state, microprocessor 52 resets its internal timer and validator 10 is thereby entering the disabled mode for another 15 minute period. Capacitor 80 in diode 82 prevent memory 78 from losing its contents during periods when external power is disconnected from validator 10. Capacitor 80 stores sufficient charge when external power is connected to validator 10 in order to maintain the contents of memory 78 for approximately 15 minutes when the external power is disconnected.

In one form of the invention, bill validator 10 evaluates paper articles. Bill guide 12 receives the paper articles 14. Pickup heads 38 and 40, microprocessor 52, motor 22 and its associated transport apparatus constitute means for validating the received articles corresponding to genuine currency and for rejecting other articles. Switch 43, tachometer 24 and the counter of microprocessor 52 constitute means for measuring a portion of the article which passes a predetermined position (i.e., the position of the switch 43) of the bill guide 12 during receiving by the bill guide 12. Heads 38 and 40, switch 43, tachometer 24 and the counter of microprocessor 52 also constitute means for further measuring the portion of the article 14 and any other articles which pass the predetermined position during rejection. Microprocessor 52 constitutes means responsive to the measuring means for disabling the bill validator 10 (such as by failing to energize pins 15 and 16 to drive motor 22) if the measurement of the portion of the article 14 during receiving differs from the measurement during rejection. As a result, the bill validator 10 is disabled in the event that a user attempts to remove an article with a rejected article causing the measurement of the received article to differ from the measurement taken during rejection.

Tachometer 24 constitutes a generator coupled to the motor 22 to generate pulses corresponding to rotation of the motor 22 as the motor transports the article 14 along the bill guide 12. Microprocessor 52 includes a counter to count the Pulses during the period that the article passes the predetermined position. As a result, the number of counted pulses corresponds to the measurement of the portion of the article 14 which passes the predetermined position.

Figure 3:
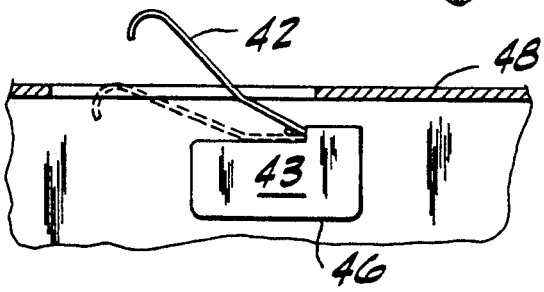
FIG. 3 is a partial sectional view along line 3—3 of FIG. 2.

Switch 43 constitutes a two-position switch on the bill guide 12 in a path of the received paper articles 14. Switch 43 is in a first position, such as illustrated in Phantom in FIG. 3, when the article 14 is over the switch 43 and is in a second position, such as illustrated in FIGS. 2 and 3, when the article 14 is not over the switch.

Preferably, microprocessor 52 resets the count to 0 when the leading edge of article 14 first reaches the predetermined position and trips switch 43. Thereafter, the microprocessor increments the counter to count during the remainder of the period of receiving of article 14. When the article 14 is rejected, the microprocessor 52 decrements the counter to count during the period beginning with the rejection of the article and ending with the time when the trailing edge of articles being discarded passes the predetermined position of switch 43. Due to slippage and other factors, the incremented and decremented counts may not be exactly equal. Generally, the bill validator will be disabled if the counts are not nearly equal. For example, in one preferred embodiment, microprocessor 42 would disable the bill validator if the count in the counter after rejection of the article is not less than twelve percent (12%) of the maximum value stored in the counter during receiving.

Pins 15 and 16 of microprocessor 52 constitute a power supply selectively connected to the validating and rejecting means. Microprocessor 52 is part of a circuit for selectively disconnecting the power supply from the validating and rejecting means during predetermined periods. RAM 78 constitutes a non-volatile memory for storing data representative of a disabled state for the bill validator during periods when power is not supplied to the bill validator.

As various changes could be made in the above constructions without departing from the scope of the invention, it is intended that all matter contained in the above description or shown in the accompanying drawings shall be interpreted as illustrative and not in a limiting sense.

Switch 43 constitutes a sensor for measuring the portion of the article which passes its position. Microprocessor 52 then constitutes disabling means responsive to the sensor to disable the bill validator.

What is claimed is:

1. A bill validator for evaluating paper articles comprising:

a bill guide for receiving the paper articles;

means for validating the received articles corresponding to genuine currency and for rejecting other articles;

means for measuring a portion of the article which passes a predetermined position of the bill guide during receiving by the bill guide and for further measuring the portion of the article and any other articles which pass the predetermined position during rejection; and means responsive to the measuring means for disabling the bill validator if the measurement of the portion of the article during receiving differs from the measurement during rejection, whereby the bill validator is disabled in the event that a user attempts to remove an article with a rejected article causing the measurement of the received article to differ from the measurement taken during rejection.

2. The validator of claim 1 wherein the disabling means comprises means for disabling the bill validator for a predetermined period of time.

3. The validator of claim 2 wherein the measuring means comprises a switch for detecting the presence of an article at the predetermined position.

4. The validator of claim 3 wherein the validating and rejecting means comprises a motor for transporting an article along the bill guide and wherein the measuring means comprises:

a generator coupled to the motor to generate pulses corresponding to rotation of the motor as it transports the article along the bill guide; and a counter to count the pulses during the period that the article passes the predetermined position, whereby the number of counted pulses corresponds to the measurement of the portion of the article which passes the predetermined position.

5. The validator of claim 1 wherein the measuring means comprises a switch for detecting the presence of an article at the predetermined position.

6. The validator of claim 5 wherein the switch comprises a two position switch on the bill guide in a path of the received paper articles and wherein the switch is in the first position when the article is over the switch and wherein the switch is in the second position when the article is not over the switch.

7. The validator of claim 5 wherein the validating and rejecting means comprises a motor for transporting an article along the bill guide and wherein the measuring means comprises:

a generator coupled to the motor to generate pulses corresponding to rotation of the motor as it transports the article along the bill guide; and a counter to count the pulses during the period that the article passes the predetermined position, whereby the number of counted pulses corresponds to the measurement of the portion of the article which passes the predetermined position.

8. The validator of claim 1 wherein the validating and rejecting means comprises a motor for transporting an article along the bill guide and wherein the measuring means comprises:

a generator coupled to the motor to generate pulses corresponding to rotation of the motor as it transports the article along the bill guide; and a counter to count the pulses during the period that the article passes the predetermined position, whereby the number of counted pulses corresponds to the measurement of the portion of the article which passes the predetermined position.

9. The validator of claim 8 wherein the count stored in the counter is reset to zero when the leading edge of the article first reaches the predetermined position, wherein the counter increments the count during the remainder of the period of receiving, and wherein the counter decrements the count during the period beginning with the rejection of the article and ending with the time when the trailing edge of articles being discarded passes the predetermined position.

10. The validator of claim 9 wherein the disabling means disables the bill validator if the count in the counter after rejection of the article is not less than 12% of the maximum value stored in the counter during receiving.

11. The validator of claim 8 wherein the disabling means comprises means for disabling the bill validator for a Predetermined period of time.

12. The validator of claim 1 wherein the validator comprises a power supply selectively connected to the validating and rejecting means and wherein the disabling means comprises a circuit for selectively disconnecting the power supply from the validating and rejecting means during predetermined periods.

13. The validator of claim 12 wherein the disabling means comprises a nonvolatile memory for storing data representative of a disabled state for the bill validator during periods when power is not supplied to the bill validator.

14. A bill validator for evaluating paper articles comprising:

a bill guide for receiving the paper articles;

a bill detector for validating the received articles corresponding to genuine currency and for rejecting other articles;

a sensor for measuring a portion of the article which passes a predetermined position of the bill guide during receiving by the bill guide and for further measuring the portion of the article and any other articles which pass the predetermined position during rejection; and disabling means responsive to the sensor to disable the bill validator if the measurement of the portion of the article during receiving differs from the measurement taken during rejection, whereby the bill validator is disabled in the event that a user attempts to remove an article with a rejected article causing the measurement of the received article to differ from the measurement taken during rejection.

15. The validator of claim 14 wherein the disabling means comprises a circuit for disabling the bill validator for a predetermined period of time.

16. The validator of claim 14 wherein the sensor comprises a switch for detecting the presence of an article at the predetermined position.

17. The validator of claim 14 further comprising a motor for transporting an article along the bill guide and wherein the sensor comprises:

a generator coupled to the motor to generate pulses corresponding to rotation of the motor as it transports the article along the bill guide; and a counter to count the pulses during the period that the article passes the predetermined position, whereby the number of counted pulses corresponds to the measurement of the portion of the article which passes the predetermined position.

18. A method of securing the currency in a bill validator comprising the steps of:

receiving paper articles through a bill guide;

validating received articles corresponding to genuine currency;

rejecting articles not validated;

measuring a portion of the received article which passes a predetermined position of the bill guide during receiving by the bill guide;

measuring the portion of the article and any other articles which pass the predetermined position during rejection; and disabling the bill validator if the measurement of the portion of the article during receiving differs from the measurement during rejection, whereby the bill validator is disabled in the event that a user attempts to remove an article with a rejected article causing the measurement of the received article to differ from the measurement taken during rejection.

19. The method of claim 18 wherein the disabling step comprises the step of disabling the bill validator for a predetermined period of time.

20. The method of claim 19 wherein the measuring step comprises the step of detecting the presence of an article at the predetermined position.

21. The method of claim 20 further comprising the step of transporting an article along the bill guide and wherein the measuring step comprises the steps of:

generating pulses corresponding to transporting of articles along the bill guide; and counting the pulses during the period that the article passes the predetermined position, whereby the number of counted pulses corresponds to the measurement of the portion of the article which passes the predetermined position.

22. The method of claim 18 wherein the measuring step comprises the step of detecting the presence of an article at the predetermined position.

23. The method of claim 22 further comprising the step of transporting an article along the bill guide and wherein the measuring step comprises the steps of:

generating pulses corresponding to transporting of the article along the bill guide; and counting the pulses during the period that the article passes the predetermined position, whereby the number of counted pulses corresponds to the measurement of the portion of the article which passes the predetermined position.

24. The method of claim 18 further comprising the step of transporting an article along the bill guide and wherein the measuring step comprises the steps of:

generating pulses corresponding to transporting of the article along the bill guide; and counting the pulses during the period that the article passes the predetermined position, whereby the number of counted pulses corresponds to the measurement of the portion of the article which passes the predetermined position.

25. The method of claim 24 wherein the counting step comprises the steps of resetting the count to zero when the leading edge of the article first reaches the predetermined position, incrementing the count during the remainder of the period of receiving, and decrementing the count during the period beginning with the rejection of the article and ending with the time when the trailing edge of articles being discarded passes the predetermined position.

26. The method of claim 25 wherein the disabling step comprises the step of disabling the bill validator if the count after rejection of the article is not less than 2% of the maximum count during insertion.

27. The method of claim 24 wherein the disabling step comprises the step of disabling the bill validator for a predetermined period of time.

28. The method of claim 18 wherein the validator is selectively powered by a power supply and wherein the disabling step comprises the step of selectively disconnecting the power supply from the validator during predetermined periods.

29. The method of claim 28 wherein the disabling step comprises the step of storing data representative of a disabled state for the bill validator in a nonvolatile memory during periods when the power supply is not supplied with electrical power.

30. A bill validator for evaluating paper articles comprising:

a bill guide for receiving the paper articles;

means for validating the received articles corresponding to genuine currency and for rejecting other articles;

means for detecting tampering in which one or more of the validated articles is rejected with one or more of the other articles; and means responsive to the detecting means for disabling the bill validator when the detecting means detects said tampering, whereby the bill validator is disabled in the event that a user attempts to tamper with the bill validator by removing coin or currency in an unauthorized manner.

31. The validator of claim 30 wherein the disabling means comprises means for disabling the bill validator for a predetermined period of time after the detecting means detects said tampering.

32. The validator of claim 30 wherein the disabling means comprises means for disabling the bill validator for about 15 minutes after the detecting means detects said tampering.

33. A method of securing the currency in a bill validator comprising the steps of:

receiving the paper articles;

validating the received articles corresponding to genuine currency;

rejecting articles not validated;

detecting tampering in which one or more of the validated articles is rejected with one or more of the other articles; and disabling the bill validator when said tampering is detected during the detecting step, whereby the bill validator is disabled in the event that a user attempts to tamper with the bill validator by removing coin or currency in an unauthorized manner.

34. The method of claim 33 wherein the disabling step comprises the step of disabling the bill validator for a predetermined period of time after said tampering is detected.

35. The method of claim 33 wherein the disabling step comprises the step of disabling the bill validator for about 15 minutes after said tampering is detected.

* * * * *